United States Patent [19]

Zecman

[11] 4,089,679

[45] May 16, 1978

[54] STEEL ALLOY FOR ZINC AND ALUMINUM DIE CASTING

[75] Inventor: Kenneth Zecman, Plymouth, Mich.

[73] Assignee: Pennsylvania Steel Corporation, Detroit, Mich.

[21] Appl. No.: 733,259

[22] Filed: Oct. 18, 1976

[51] Int. Cl.[2] ..... C22C 38/22

[52] U.S. Cl. ..... 75/126 C; 148/36

[58] Field of Search ..... 148/36; 75/126 C, 124

[56] References Cited

U.S. PATENT DOCUMENTS

| | | | |
|---|---|---|---|
| 2,572,191 | 10/1951 | Payson | 75/126 C |
| 3,600,161 | 8/1971 | Inouye et al. | 75/126 C |

FOREIGN PATENT DOCUMENTS

| | | | |
|---|---|---|---|
| 1,533,433 | 7/1965 | Germany | 148/36 |
| 45-32813 | 1/1966 | Japan | 148/36 |

*Primary Examiner*—Arthur J. Steiner

*Attorney, Agent, or Firm*—Cullen, Settle, Sloman & Cantor

[57] ABSTRACT

A steel alloy composition consists essentially of the following ingredients by weight in the range: Carbon - 0.12 to 0.17%; Manganese - 0.75 to 0.85%; Silicon - 0.15 to 0.35%; Chromium - 1.40 to 1.85%; Molybdenum - 0.40 to 0.50%; Tungsten - 0.10 to 0.15%; Iron - the balance. The method of making nozzles, noses, plungers, and shot sleeves which includes the above composition, for use in zinc and aluminum die casting includes machining the product and heat-treating.

4 Claims, No Drawings

STEEL ALLOY FOR ZINC AND ALUMINUM DIE CASTING

BACKGROUND OF THE INVENTION

Heretofore, it has been known to provide steel alloys which include some of the ingredients: Carbon, Manganese, Silicon, Chromium, Molybdenum, Tungsten and Iron. All of the above ingredients, but in a limited specific range are required to provide a steel alloy highly effective when used in making nozzles noses, plungers, and shot sleeves for die casting.

BRIEF DESCRIPTION OF THE INVENTION

It is an object of the present invention to provide an improved steel alloy composition for nozzles, noses, plungers and shot sleeves used for zinc and aluminum die casting.

It is a further object to provide a steel alloy composition which includes: Carbon, Manganese, Silicon, Chromium, Molybdenum, Tungsten and Iron in a certain specific range of proportions by weight which will be highly effective in nozzles, noses, plungers and shot sleeves for zinc and aluminum die casting.

It is a further object to provide a novel method of making such nozzles, noses, plungers and shot sleeves of the aforesaid ingredients which includes machining and heat-treating for the desired hardness.

These and other objects will be seen from the following specification and Claims.

DETAILED DESCRIPTION OF THE INVENTION

The present invention is directed to a steel alloy composition which is particularly adapted, though not limited to, the manufacture of nozzles, noses, and plungers for use in the zinc die casting industry and for shot sleeves for use in the aluminum die casting industry.

The composition consists essentially of: Carbon, Manganese, Silicon, Chromium, Molybdenum, Tungsten and the balance Iron, in certain predetermined proportions which will achieve the desired characteristics hereafter set forth such nozzles, noses, plungers and shot sleeves.

It has been found that the present steel alloy composition consists essentially of the following ingredients in the proportions by weight indicated and in the ranges set out as follows:

| | |
|---|---|
| Carbon | .12 to .17% |
| Manganese | .75 to .85% |
| Silicon | .15 to .35% |
| Chromium | 1.40 to 1.85% |
| Molybdenum | .40 to .50% |
| Tungsten | .10 to .15% |
| Iron | Balance. |

Under these ranges, there are hereunder set forth several specific examples of preferred compositions:

| | |
|---|---|
| Example No. 1 | |
| Carbon | .15% |
| Manganese | .67% |
| Silicon | .30% |
| Chromium | 1.77% |
| Molybdenum | .47% |
| Tungsten | .11% |
| Iron | Balance. |
| Example No. 2 | |
| Carbon | .15% |

-continued

| | |
|---|---|
| Manganese | .76% |
| Silicon | .30% |
| Chromium | 1.83% |
| Molybdenum | .45% |
| Tungsten | .12% |
| Iron | Balance. |
| Example No. 3 | |
| Carbon | .14% |
| Manganese | .80% |
| Silicon | .25% |
| Chromium | 1.60% |
| Molybdenum | .45% |
| Tungsten | .12% |
| Iron | Balance. |

The present invention contemplates making nozzles, noses, plungers and shot sleeves for use in zinc and aluminum die casting which includes the following ingredients in the proportions by weight:

| | |
|---|---|
| Carbon | .12 to .17% |
| Manganese | .75 to .85% |
| Silicon | .15 to .35% |
| Chromium | 1.40 to 1.85% |
| Molybdenum | .40 to .50% |
| Tungsten | .10 to .15% |
| Iron | Balance. |

After machining, the products are heat treated. The heat treatment is such as to provide a hardness range of 210 to 240 Brinell, for nozzles, noses and plungers. For the shot sleeves, the heat treatment is such as to provide a hardness range of 255 to 300 Brinell. The steel is quenched in water from 1,600° F. and tempered to the desired hardness.

In making the steel alloy for these products, the molten composition from the furnace is poured while maintaining the ladle under low atmospheric pressure for vacuum-de-gassing. This procedure tends to eliminate hydrogen imbrittlement from trapped hydrogen gas. While it is not essential to the end product, it appears to provide an improved product for use in the die casting industry. The heat treatment provides a pre-hardened product which will stand up under long use when used as a nozzle, a nose or plunger for zinc die casting and when used for shot sleeves in aluminum die casting. The specific composition resists cracking and erosion resistant.

The composition resists heat checking and is less expensive than other products heretofore used. In use of the nozzle or nose for zinc die casting, molten zinc is delivered at about 800° F. With shot sleeves for aluminum die casting, the molten aluminum is delivered at about 1,200° F.

The present composition is easier to machine than other products.

While there has been set forth generally the proposed or suggested range of use of the respective ingredients in the proportions by weight indicated, and while certain specific examples have been set forth as preferred examples, it is contemplated that other specific proportions could be employed within the range above indicated.

Having described my invention, reference should now be had to the following Claims.

I claim:

1. A steel alloy composition consisting essentially of the following ingredients by weight approximately:

| | |
|---|---|
| Carbon | .15% |

-continued

| | |
|---|---|
| Manganese | .67% |
| Silicon | .30% |
| Chromium | 1.77% |
| Molybdenum | .47% |
| Tungsten | .11% |
| Iron | Balance. |

2. A steel alloy composition consisting essentially of the following ingredients by weight approximately:

-continued

| | |
|---|---|
| Carbon | .15% |
| Manganese | .76% |
| Silicon | .30% |
| Chromium | 1.83% |
| Molybdenum | .45% |
| Tungsten | .12% |
| Iron | Balance. |

3. The alloy composition as defined in claim 1, wherein the alloy has a Brinell hardness in the range of from about 210 to about 300.

4. The alloy composition as defined in claim 2, wherein the alloy has a Brinell hardness in the range of from about 210 to about 300.

* * * * *